US005672115A

United States Patent [19]

Sanchez et al.

[11] Patent Number: 5,672,115

[45] Date of Patent: Sep. 30, 1997

[54] GOLF SWING TRAINING DEVICE AND METHOD

[75] Inventors: Richard D. Sanchez, 18910 SW 93rd Ave., Miami, Fla. 33157; Gunther H. Steen, 1632 S. Bayshore Ct., Villa No. 1, Miami, Fla. 33133

[73] Assignees: Richard D. Sanchez; Gunther H. Steen, both of Miami, Fla.

[21] Appl. No.: 702,263

[22] Filed: Aug. 23, 1996

[51] Int. Cl.[6] ..... A63B 69/36

[52] U.S. Cl. ..... 473/216; 473/140; 473/268; 473/277; 473/397; 473/398; 473/409; 273/DIG. 19; 273/DIG. 21

[58] Field of Search ..... 473/215, 216, 473/140, 268, 277, 397, 398, 409; 273/DIG. 21, DIG. 19

[56] References Cited

U.S. PATENT DOCUMENTS

| | | | |
|---|---|---|---|
| 2,469,301 | 5/1949 | Johnston . | |
| 2,626,151 | 1/1953 | Jenks | 473/216 X |
| 2,755,091 | 7/1956 | Hara . | |
| 3,079,152 | 2/1963 | Cushing . | |
| 3,215,438 | 11/1965 | Sheldon et al. . | |
| 3,623,733 | 11/1971 | Cavanaugh . | |
| 3,698,721 | 10/1972 | Stewart . | |
| 3,861,688 | 1/1975 | Butler . | |
| 3,870,317 | 3/1975 | Wilson . | |
| 3,937,473 | 2/1976 | Blasi . | |
| 3,992,011 | 11/1976 | Jessee . | |
| 4,000,904 | 1/1977 | Poortman . | |
| 4,895,372 | 1/1990 | Muller . | |
| 5,048,836 | 9/1991 | Bellagamba . | |
| 5,188,366 | 2/1993 | Dorotinsky et al. . | |
| 5,303,927 | 4/1994 | Perry et al. . | |
| 5,308,074 | 5/1994 | Dorotinsky et al. . | |
| 5,358,250 | 10/1994 | Spencer . | |
| 5,397,121 | 3/1995 | Gipson et al. . | |

*Primary Examiner*—George J. Marlo
*Attorney, Agent, or Firm*—Robert C. Kain, Jr.

[57] ABSTRACT

The golf swing training device includes a position sensing unit, a tee mounted on a tee platform and a visual and audio response unit. A taut, movable cord is attached to the hip of the golfer and to the position sensing unit. The position sensing unit generates forward, rearward and fore-strike position signals based upon a forward optimal position, a rearward optimal position and an excessive forward position of the hip of the golfer. This excessive forward hip position is preferable immediately prior to striking the ball and corresponds to the fore-strike position signal. The visual and audio response unit, located adjacent the tee platform, visually indicates to the golfer when his or her hips exceed the forward optimal position, and the rearward optimal position. These are negative feedback signals. The method includes providing a taut, movable cord attached to the hip of the golfer, sensing the forward and rearward movement of the hip based upon the position of a reference point on the cord and with respect to a fixed, neutral position, generating a first and a second visual signal to the golfer when the golfer's hips respectively move beyond a forward optimal position and a rearward optimal position, and generating an audible signal when the golfer's hips move beyond an excessive forward position indicating an ideal hip position immediately prior to striking the ball. This audio signal provides positive feedback to the golfer.

25 Claims, 5 Drawing Sheets

GOLF SWING TRAINING DEVICE AND METHOD

The present invention relates to a golf swing training device which provides both visual and audio feedback signals, as respective negative and positive feedback signals, to a golfer and a method therefor.

BACKGROUND OF THE INVENTION

There are several prior art training devices for golfers to improve their golf swing.

U.S. Pat. No. 3,861,688 to Butler discloses a golf swing training device that signals the user when one portion of the user's body (such as the hips) moves a predetermined amount relative to another portion of the golfer's body or a stationary object such as the ground. An elastic member stretches between the signalling device worn by the golfer and the connector to the other portion of the golfer's body or the ground.

U.S. Pat. No. 3,079,152 to Cushing discloses a golf practicing device in which the golfer stands within a ring surrounding the hips of a golfer. A bell is attached to the ring so that if the golfer sways his hips and touches the rings, the bell will sound.

U.S. Pat. No. 3,937,473 to Blasi discloses a golf swing training device in which a band fits freely about the golfer's waist without contact to the user's body. The inside of the band is fitted with contact switches which actuate an alarm signal when touched by the user's body.

U.S. Pat. No. 3,215,438 to Sheldon et al. discloses a training device for a golfer to teach proper hip movement. If the golfer improperly moves his hips, an alarm will sound to indicate improper pivot movement.

U.S. Pat. No. 2,755,091 to Hara discloses a golf practice device in which a belt is attached to the golfer's pelvic region to control pivotal movements of the hips.

U.S. Pat. No. 4,000,904 to Poortman and U.S. Pat. No. 3,992,011 to Jessee disclose tee off devices for training a golfer to keep his body stationary when teeing off. The tee off device emits a flash of light of a particular color as soon as a golf bail is teed off.

The following patent disclosures illustrate belts to be worn by a golfer to train his golf swing: U.S. Pat. Nos. 5,048,836; 3,870,317; 5,188,366; 5,308,074; 5,303,927; 5,358,250 and 5,397,121.

U.S. Pat. No. 4,895,372 to Muller teaches a golf training device that includes a hip guide and a sounding device.

The following patent disclosures illustrate golf trig devices for keeping the golfer's hips in proper alignment: U.S. Pat. Nos. 2,469,301; 3,623,733 and 3,698,721.

OBJECTS OF THE INVENTION

It is an object of the present invention to provide a golf swing training device which provides visual and audio feedback to the golfer to improve his or her swing.

It is a further object of the present invention to provide a method of enhancing the golf swing based on visual and audio feedback to the golfer.

It is an additional object of the present invention to provide a device and a method which visually indicates when the golfer's hips have moved beyond forward and rearward optimal positions and to provide an audio feedback signal when the golfer's hips move beyond an excessive forward position which is preferable immediately prior to striking the golf bail from the tee. The audio feedback signal is a positive reinforcement to enhance the golfer's swing.

It is another object of the present invention to provide a device which is compact and portable.

SUMMARY OF THE INVENTION

The golf swing training device includes a position sensing unit, a tee mounted on a tee platform and a visual and audio response unit. A taut, movable cord is attached to the hip of the golfer and to the position sensing unit. The position sensing unit generates forward, rearward and fore-strike position signals based upon a forward optimal position, a rearward optimal position and an excessive forward position of the hip of the golfer. This excessive forward hip position is preferable immediately prior to striking the ball and corresponds to the fore-strike position signal. The visual and audio response unit, located adjacent the tee platform, visually indicates to the golfer when his or her hips exceed the forward optimal position, and the rearward optimal position. These are negative feedback signals. The method includes providing a taut, movable cord attached to the hip of the golfer, sensing the forward and rearward movement of the hip based upon the position of a reference point on the cord and with respect to a fixed, neutral position, generating a first and a second visual signal to the golfer when the golfer's hips respectively move beyond a forward optimal position and a rearward optimal position, and generating an audible signal when the golfer's hips move beyond an excessive forward position indicating an ideal hip position immediately prior to striking the ball. This audio signal provides positive feedback to the golfer.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a golf swing training device and a method therefor.

Figure 1:
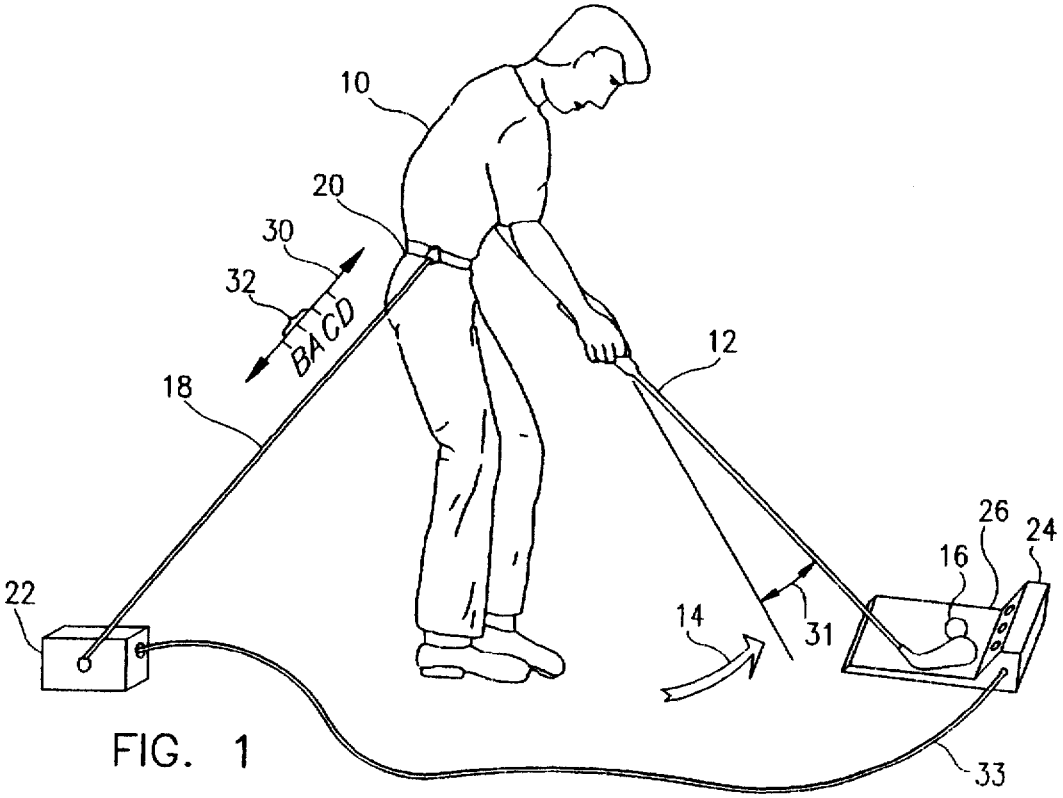
FIG. 1 diagrammatically illustrates the golfer, the position sensing unit, the tee platform and the visual and audio response unit in accordance with the principles of the present invention.

FIG. 1 diagrammatically illustrates golfer 10 holding a golf club 12 in his hands. As is commonly known, golfer 10 initially moves golf club 12 in a rearward position, opposite arrow 14, as part of his backswing. Thereafter, the golfer swings club 12 in a forward motion in the direction of arrow 14 in order to strike golf ball 16.

The present invention utilizes a taut, movable cord 18 which, in its simplest configuration, senses the position of hips 20 of golfer 10 with a position sensing unit 22. The golfer is provided visual feedback signals (as negative feedback signals) and audio feedback signals (as positive feedback signals) from visual and audio response unit 24. In addition, as explained later, golf ball 16 is mounted on a pivoting tee on tee platform 26. In summary, the present invention provides visual feedback to golfer 10 based upon the position of hip 20 and reference line 30. In neutral position A which is between rearward optimal position B and forward optimal position C, that is, in region 32 on reference line 30, golfer 10 sees a green light which is a neutral position visual indicator. If the golfer's hips move beyond rearward optimal position B, a red light visually indicates to the golfer that his hips have moved beyond the rearward optimal position. If the golfer's hips move beyond the forward optimal position C, a different red light is lit on visual and audio response unit 24. During the backswing, the golfer should either keep the green, neutral position light lit or at least insure that the forward and rearward optimal red position lights are not lit. Immediately prior to golf club 12 hitting ball 16, the golfer should move his hips forward beyond the forward optimal position such that his hips are in an excessive forward position. At the excessive forward position, point D on reference line 30, visual and audio response unit 24 issues an audible signal, such as a buzz, indicating that the golfer's hips are in the correct position to strike ball 16. The buzzer or audio signal should be heard by golfer 10 when club 12 is generally 6–8 inches away from the illustrated position, that is, approximately distance 31 from the club position shown in FIG. 1. In this manner, the golfer is provided with visual negative feedback signals to insure a proper backswing and a proper foreswing as well as an audible positive feedback signal to insure that the golfer moves his or her hips to an excessive forward position immediately prior to striking the ball. The hips should lead the striking of the ball. If the golfer does not hear the buzzer prior to striking the ball, it will be immediately apparent to the golfer that he or she has not moved his or her hips to an excessive forward position. In this manner, the present device and present method provides positive feedback to improve the golfer's swing. This is in contrast to many of the prior art devices that are discussed above.

FIG. 1 shows that position sensing unit 22 is electrically connected via cable 33 to visual and audio response unit 24. The taut but movable cord 18 monitors the position of hips 20 of golfer 10. The cord is under a light degree of tension and is an elastic cord. Golfer 10 places position sensing unit 22 at an appropriate distance away from his or her standing position such that the neutral visual indicator (green light) is lit on visual and audio response unit 24 when cord 18 is taut. In a preferred embodiment, the cord is approximately 6 feet long.

Figure 2:
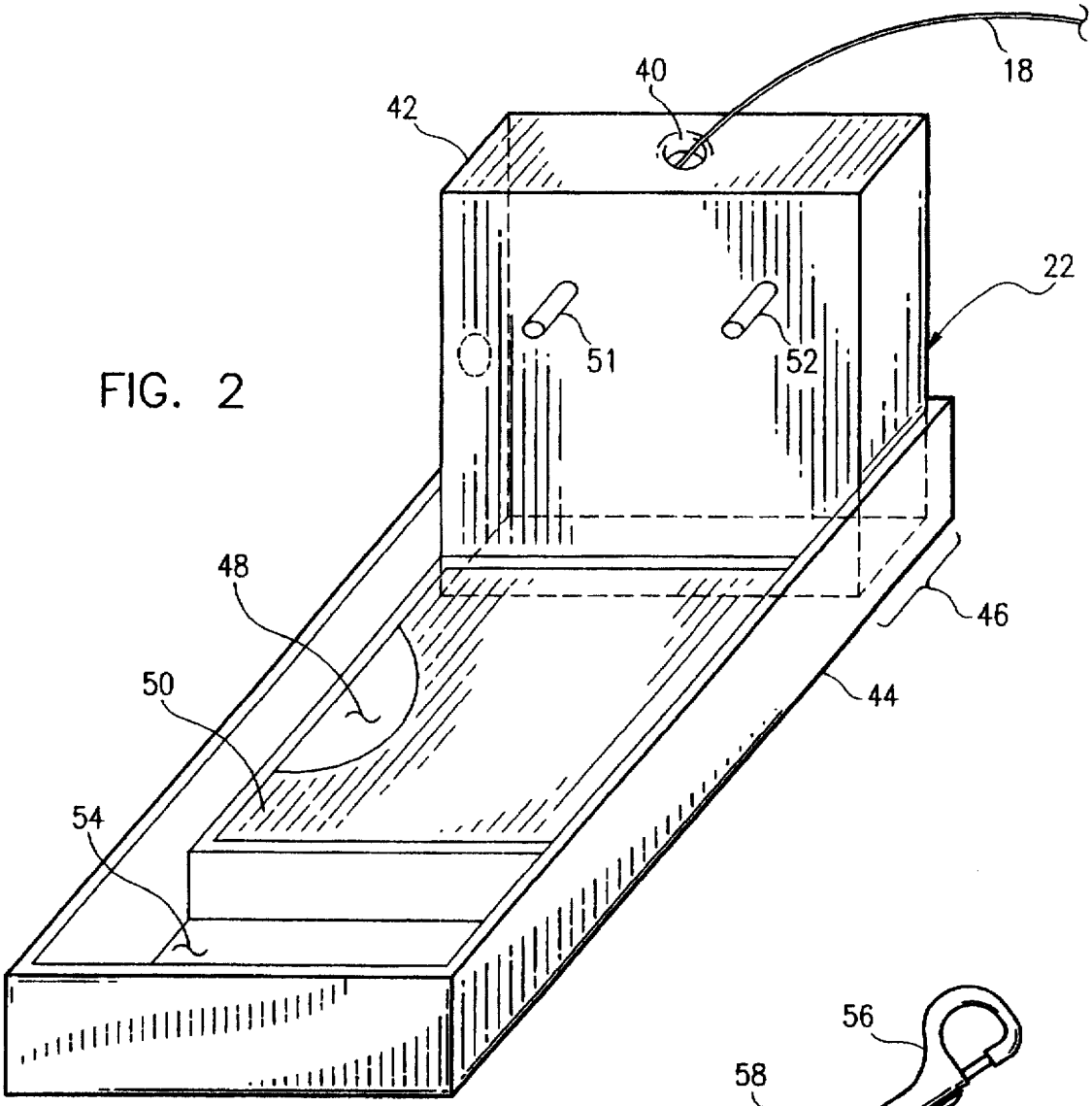
FIG. 2 diagrammatically illustrates one embodiment of the position sensing unit.

FIG. 2 diagrammatically illustrates position sensing unit 22. Cord 18 extends outward beyond hole 40 of vertical box 42. Vertical box 42 is held upright in carrying box 44 based on the interfit at rearward section 46. Container or box 44 includes a covered compartment 48 which can be utilized to store electrical coupling cable 33. A cover 50 can be removed to fully expose compartment cavity 48. In one embodiment, cord 18 can be wrapped around poles 51, 52. To store vertical box 42 in container 44, vertical box 42 is lifted from rear section 46 and placed on top of lid 50 of cavity 48. Posts 51, 52 which retain the wrapped up cord 18 during storage, are placed in the forward, open cavity 54 of container 44.

Figure 3:
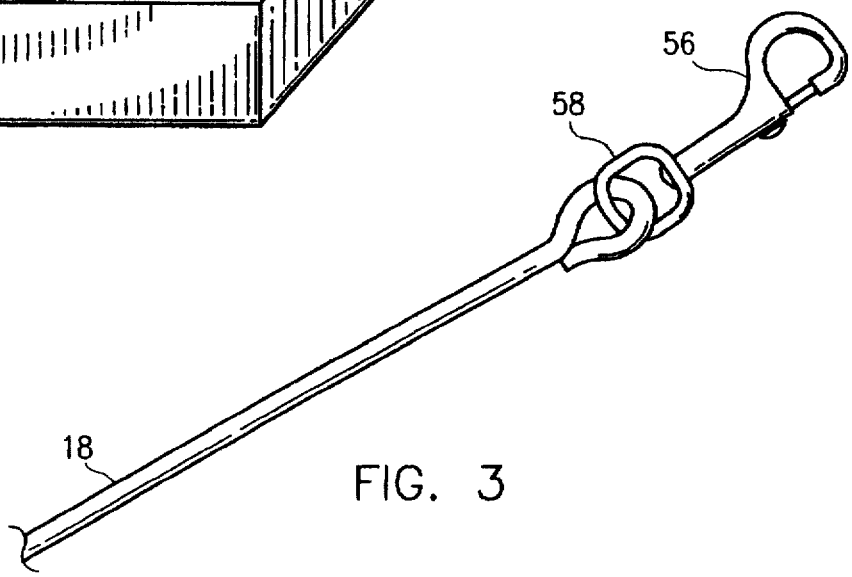
FIG. 3 diagrammatically illustrates the clip for attaching the movable cord to the hip of the golfer.

FIG. 3 diagrammatically shows cord 18 having a clip 56. Clip 56 is attached to cord 18 by a ring 58 or other type of attachment mechanism. Clip 56 includes a rearwardly movable member 59. Clip 56 can be hooked on a belt or a belt loop of golfer 10 as shown in FIG. 1.

Figure 4:
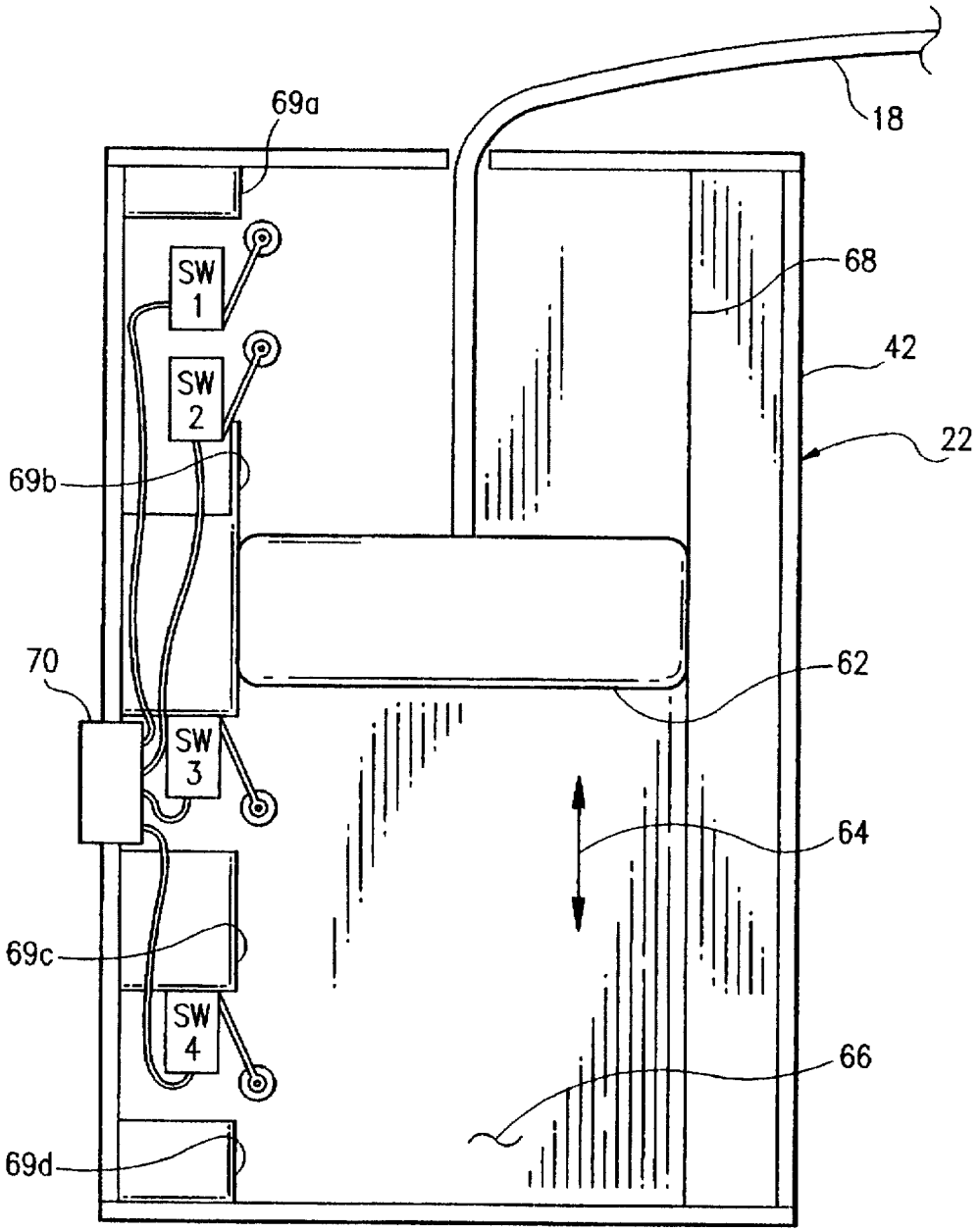
FIG. 4 diagrammatically illustrates position sensing switches which indicate forward, rearward, neutral and fore-strike positions of the cord which correlate to the position of the golfer's hips.

FIG. 4 diagrammatically illustrates one embodiment of the position and sensing unit 22. Taut but movable cord 18 includes a terminal end 60 which is attached to a weight block 62. The vertical box 42 holding the position sensing unit permits weight block or terminus block 62 to move vertically up and down as shown by double-headed arrow 64 in cavity 66 of vertical box 42. Terminus block 62 is guided by a left guide member 68 and fight guide members 69A, 69B, 69C and 69D.

The position sensing unit 22, in this embodiment, includes a plurality of switches, SW1, SW2, SW3 and SW4 which generate the various position signals. The following Switch Position Table links these mechanical position switches to the electrical position signals generated by the position sensing unit.

Switch Position Table

| Switch | Hip Position | Signal |
|---|---|---|
| SW1 | Excessive forward position | Fore-strike signal |
| SW2 | Forward optimal position | Forward position signal |
| SW3 | Neutral, intermediate position | Neutral signal |
| SW4 | Rearward optimal position | Rearward signal |

Based on the position of terminus block 62, which is controlled by the position of taut but movable cord 18 and also the position of hip 20 of golfer 10, terminus block 62 closes switch 3 in a neutral position, switch 4 if the golfer's hips move beyond a rearward optimal position, switch 2 if the golfer's hips move beyond a forward optimal position, and, immediately prior to striking golf ball 16, the golfer is positively and audibly reminded to move his or her hips in an excessive forward position activating switch SW1 by sounding the buzzer 4–6 inches before the golf club head hits ball 16. In other words, the position sensing unit generates a forward position signal when the terminus 62 moves and closes switch SW2. When terminus 62 moves and closes switch SW3, the neutral or green light is indicated and lit on visual and audio response unit 22. If the golfer moves his or her hips to a rearward position in excess of the switch position, terminus 62 closes switch SW4, and the rearward position light is lit on visual and audio response unit 24. All of these positions of cord 18 are with respect to a reference point on the cord (in this case terminus block 62) and with respect to a fixed neutral position. The fixed, neutral position is generally the geographic position of positioning unit 22 and is specifically the position of reference point 60 with respect to switches SW1, SW2, SW3 and SW4.

As diagrammatically shown in FIG. 4, these switches all have electrical outputs leading to an electrical output jack 70. Electrical coupling cable 33 plugs into jack 70. A similar jack is provided on visual and audio response unit 24. It should be noted that FIG. 4 only diagrammatically illustrates the electrical connections between SW1, SW2, SW3 and SW4 and the visual and audio response unit 24. In the working embodiment, the ground terminals of all switches are electrically connected together. This ganged ground terminal is also connected to a ground conductor in jack 70 and electrical cable 33.

Figure 5:
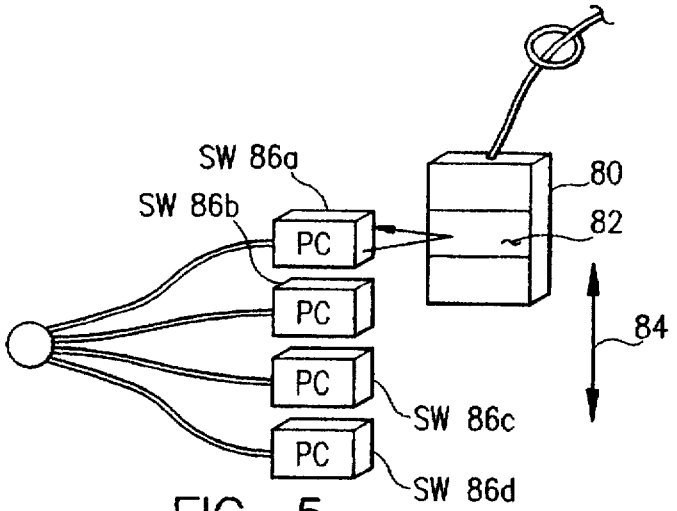
FIG. 5 diagrammatically illustrates photo-optical sensors as position sensors.

The position sensing unit could utilize a number of different mechanical, pneumatic, hydraulic and optical systems to detect the position of a reference point on cord 18. FIG. 5 diagrammatically illustrates the use of photo-optic cells or photocells PC to detect the position of terminus block 80. In this embodiment, terminus block 80 includes a light reflecting surface 82. When terminus block 80 moves in the direction shown by double-headed arrow 84, photo-optic cells 86A through 86D are activated. Essentially, these photoelectric cells emit light and then detect received light from reflective surface 82 of terminus block 80. Other photo-optical systems could be utilized to monitor the position of a reference point on the cord.

Figure 6A:
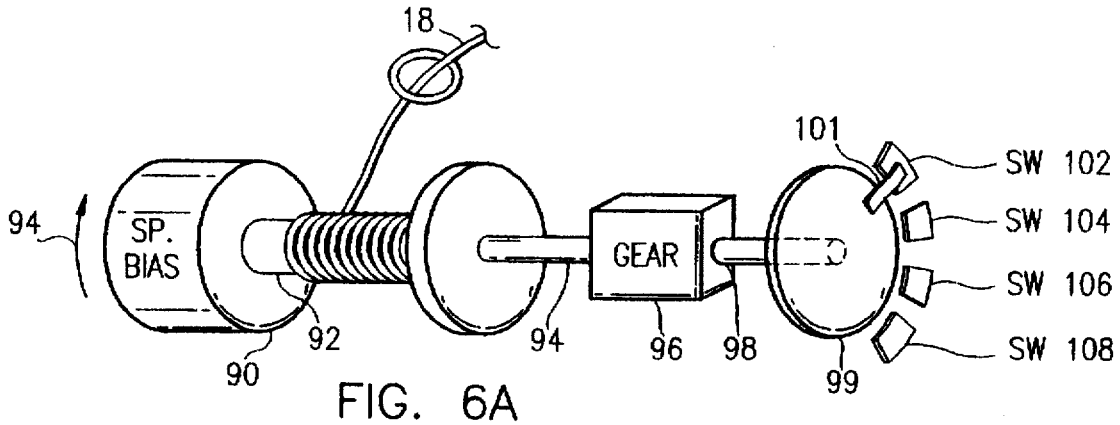
FIG. 6A diagrammatically illustrates the movable cord gathered on a reel and position sensors indicating the rotational position of the reel and hence the hip position of the golfer.

FIG. 6A shows that cord 18 could be wound upon reel 90. Reel 90 has a spring bias such that the spring gathers cord 18 about spool 92. In the illustrated embodiment, the spring bias provides a tension in the direction shown by arrow 94. Reel 90 is attached to drive axle 94. Drive axle 94 is attached to a gear system 96. The output of the gear system is applied to supplemental axle 98 and ultimately to positioning wheel 99. Positioning wheel 99 includes a stem 101 which activates switches SW102, SW104, SW106 and SW108. In this manner, the cord is rotationally biased by the spring on reel 90. The sensing device senses the angular displacement or rotational position of plate 99. Gear box 96 may be utilized to adjust the angular displacement of plate 99 to the switch positions and to the amount of cord 18 wrapped on spindle 92 of reel 90. As an alternative embodiment, the switches could be displaced about the entire periphery of wheel 99. The golfer, when the positioning sensing unit is not is use, could wind the cord 18 onto reel 90. When is use, the golfer could clip the cord on his or her hip, place the position sensing unit 22 at a reasonable distance away from the tee stand, strike a button the tee stand to set the neutral position as to one of the plurality of switches about measurement wheel 99. If a plurality of peripherally displaced switches are disposed about wheel 99, the system could then initialize that particular reference rotational position. When the golfer moves his or her hips backwards or forwards beyond the optimal amount, forward or rearward lights would flash on visual and audio response unit 24. Immediately prior to striking ball 16, the golfer would be prompted by an audible sound by movement of his or her hips to an excessive forward position. This could also be accomplished by electronically noting the original rotational position and calculating which switch from the set SW102–SW108 would equate to the neutral position, optimal positions and excessive forward position. At the excessive forward position, a fore-strike position signal is generated and that fore-strike position signal is sent to the visual and audio response unit 24 to audibly indicate the proper hip position prior to striking the ball.

Figure 6B:
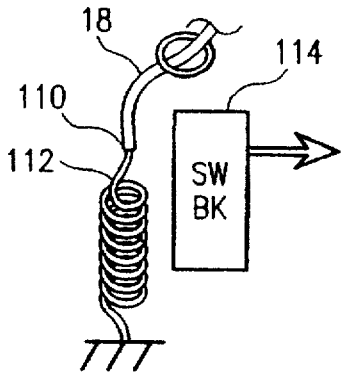
FIG. 6B diagrammatically illustrates a spring bias and a bank of switches for the position sensing unit.

FIG. 6B diagrammatically illustrates cord 18 having its terminal end 110 attached to a spring 112. A plurality of switches are diagrammatically illustrated as switch bank 114. The output of switch bank 114 provides forward and rearward optimal position signals as well as fore-strike position signals.

It should be noted that a wide variety of position sensors could be utilized. The following Position Sensor Table provides some indication of what type of position sensors and sensory systems could be utilized in position sensing unit 22.

Position Sensor Table

Hydraulic bias
Pneumatic bias
Spring bias with tension (pressure) sensor
Linear position sensors (electronic)
Rotational position sensors (measures angular displacement)

For example, with respect to the spring bias and the tension sensor, electronic devices are known which provide an electrical output based upon the amount of tension or, negative pressure applied to the surface of the device. These devices are called piezoelectric sensors. If piezoelectric sensors are utilized, the position sensor unit 22 may include a power source, voltage regulators and convertors, signal conditioning circuits such as analog to digital convertors and microcontrollers. The electrical signals sent from position sensing unit 22 to the visual and audio response unit 24 could be sent via electrical cord 33 or could be sent via infrared transmissions or radio frequency R.F. transmissions. This is shown in conjunction with FIG. 12 discussed later. The claims appended hereto are meant to cover these position sensors as well as other position sensors identified in the Position Sensor Table set forth above.

Figure 7:
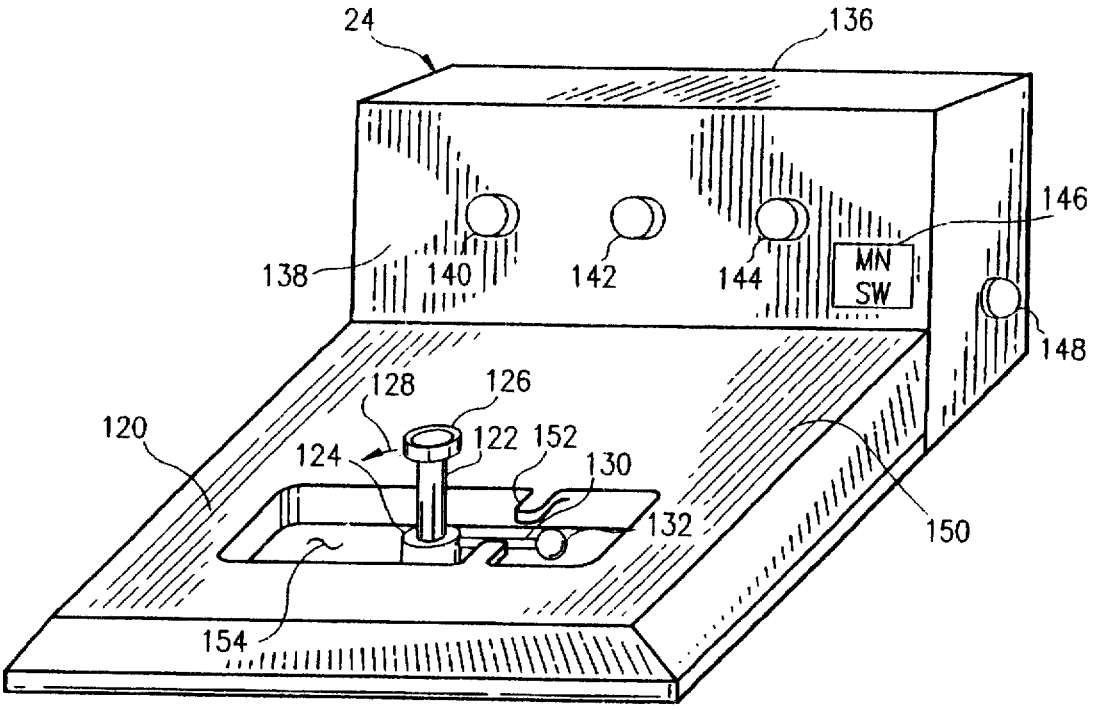
FIG. 7 diagrammatically illustrates the tee platform and the visual and audio response unit.

FIG. 7 diagrammatically illustrates one embodiment of the visual and audio response unit 24. This unit includes a tee platform 120 on which is mounted a golf tee 122. As shown later in conjunction with FIG. 10, tee 112 is removably mounted via tee coupler 124. Tee 122 includes a ball holding surface 126. The golfer places the golf ball on ball holding surface 126. Tee 122 is pivotably mounted such that it can rotate in the direction shown by arrow 128 when the golfer strikes the ball from tee 122. Upon rotation, a sight stub 130 is raised. A small siting ball 132 provides a further visual indication to golfer 10 to keep his or her head down after he or she strikes the golf ball from tee 122. The siting ball may be brightly colored.

A visual and audio response unit 136 is on platform 120. In an actual embodiment, the position sensing unit shown in FIG. 12 can be configured as a compact, solid rectangular structure and that solid rectangular structure is placed in the L-shaped open area defined by tee platform 120 and upright display face 138 of visual and audio response unit 136. Although it is not absolutely necessary that visual and audio response unit 136 be connected to tee platform 120, it is important that the visual and audio response unit 136 is placed near tee 122 since the golfer should keep his or her eye on the ball during the entire golf swing. Particularly, visual indicators such as light emitting indicators or lamps 140, 142 and 144 should be adjacent tee 122. This enables the golfer to both see the ball on the tee and have an immediate indication whether his or her hips are too forward or are too rearwardly disposed. To activate the device, the golfer closes main power switch 146. The visual and audio response unit 136 includes an electrical jack 148. Jack 148 enables the user to plug in electrical cable 33 to electrically connect position sensing unit 22 to visual and audio response unit 24.

Siting stub 130 is kept below platform surface 150 with inwardly disposed fingers 152. Siting stub 130 is placed in depression 154 beneath surface 150. After the golfer strikes tee 122, tee 122 moves in the direction shown by arrow 128. This pivotal rotation causes siting stub 130 to pop up such that siting ball 132 provides a further visual indication to the golfer to keep his or her head down.

Figure 8:
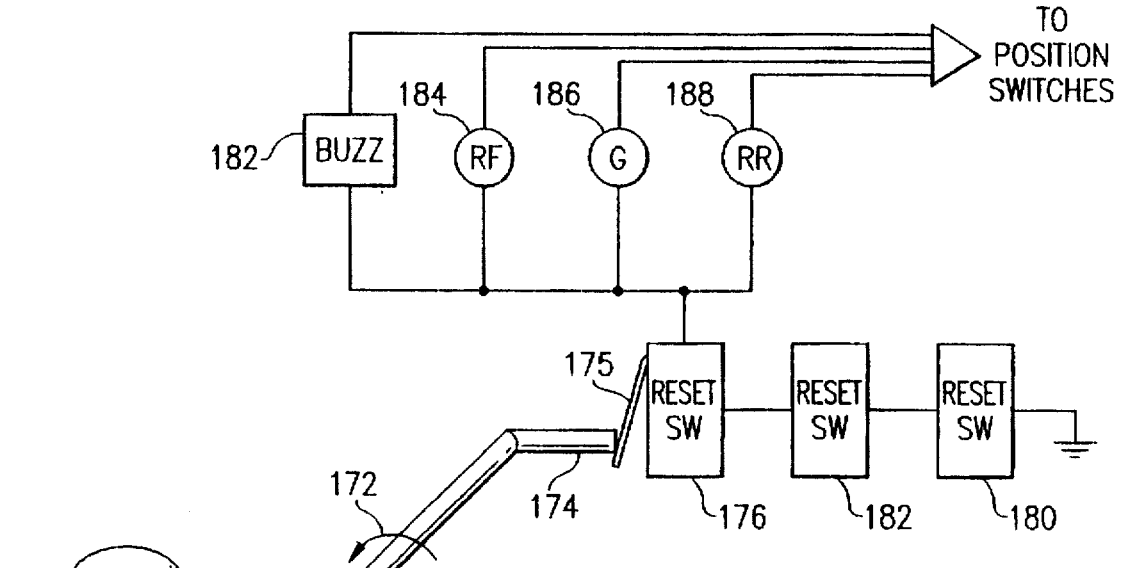
FIG. 8 diagrammatically illustrates the disabling or reset switch which is opened based upon pivotal movement of the tee and illustrates light emitting indicators and an audible device (a buzzer) providing feedback signals to the golfer.

FIG. 8 diagrammatically illustrates that tee mount 124 is attached to a rod or bar 170. Rod 170 rotates in the direction shown by arrow 172 when tee 122 is hit by the golfer during his or her golf swing. Rod 172 includes lever arm 174. When lever arm 174 moves, the state of reset switch or disabling switch 176 changes. In a preferred embodiment, the visual and audio response unit 136 includes a power source such as a battery 180, a main switch 182 and a reset or disable switch 176. If the main switch 182 and the reset switch or disabling switch 176 are closed due to the upright position of tee 122, power is supplied to the audio unit or buzzer 182, the red forward optimal position light 184, the green, intermediate, neutral position light 186 and the red rearward optimal position light 188. The lights and the buzzers are not activated unless one or more of the switches SW1–SW4 in position sensor 22 are closed. Those switches connect the lights as well as the buzzer to the ground terminal of the system. In operation, the golfer during the backswing either maintains the green light ON by maintaining the position of terminus block 62 to close switch SW3 or, at a minimum, insures that the position of his or her hips does not close fight forward switch SW2 and light up right forward optimal position light 184 and/or red rearward position light 188 by closure of switch SW4. During the golfer's forward swing, prior to the 6–8 inch fore-strike optimal position, the golfer brings down the club without lighting up lights 184 and 188. Lights 184 and 188 are not lit unless terminus block 62 closes switches SW2 or SW4. Immediately prior to striking the ball, the golfer should move his or her hips forward to an excessive forward position thereby closing switch SW1 and connecting audio signal generator or buzzer 182 to the ground terminal of the system. During the fore-strike swing, the forward light will illuminate immediately prior to the alarm. After the golfer strikes tee 122, the pivotal movement of tee 122 moves rod 172 and lever 174 moves away from switch lever 175. This changes the state of reset or disabling switch 176 and opens the circuit between buzzer 182 and battery 180. Thereafter, the circuit is dead or disabled until the golfer puts tee 122 in an upright position thereby closing reset or disabling switch 176.

Figure 9:
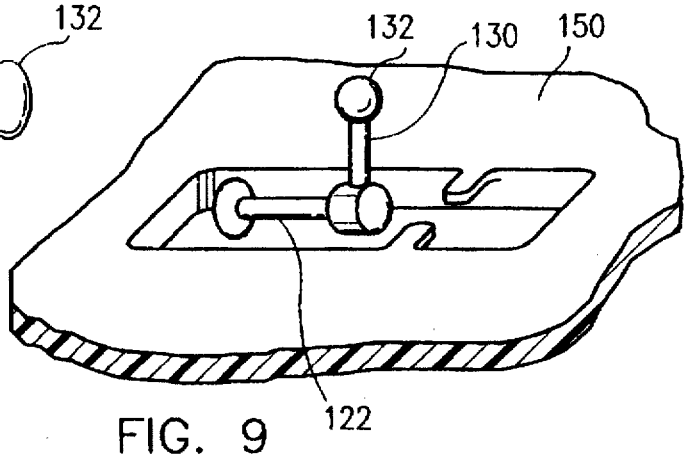
FIG. 9 is a partial, diagrammatic view of the pivoted tee.

FIG. 9 diagrammatically shows a partial view of tee platform 150. In this position, tee 122 has been rotated to its furthest position and siting stub 132 is upright. A fluorescent ball 132 is provided such that the golfer can focus his or her attention on the sight ball 132 after the golfer strikes the ball.

Various audio units can be provided to emit a positive feedback signal to the golfer. The following Audio Response Table lists some type of audio units.

Audio Response Table

Buzzer

Bell

Voice synthesis unit and speaker

Audio signal generator and speaker

If a voice synthesis unit or an audio signal generator is utilized, it may be necessary to embody the visual and audio response unit as a digital unit. This system utilizes a voltage regulator, analog to digital conversion units and microcontroller units. Rather than buzzer 182, an integrated circuit could emit an audio signal to indicate that the golfer's hips are in a fore-strike position which is an excessive forward position. Also, it is possible to physically separate the visual unit from the audio response unit. The audio response unit may be disposed in the position sensing unit.

Figure 10:
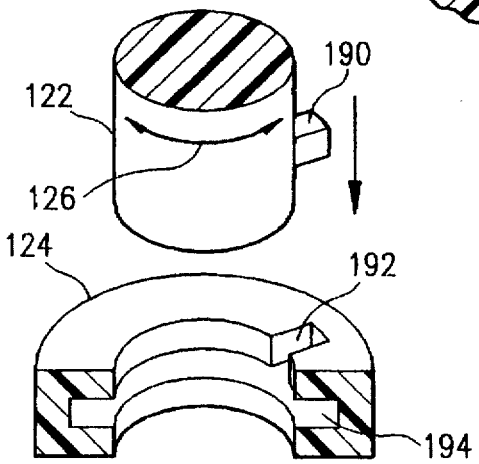
FIG. 10 diagrammatically illustrates the key at the end of the tee for mounting the tee in the tee mount.

FIG. 10 diagrammatically illustrates tee 122 having a key 190. Key 190 is vertically placed in key way 192 of tee mount 124. Thereafter, the user rotates tee 122 in the direction shown by arrow 126 to lock key 190 in channel 194. In this manner, the golfer can place tees having various heights into the tee mount. A short tee or a taller tee may be necessary depending on the preference of the golfer.

Figure 11:
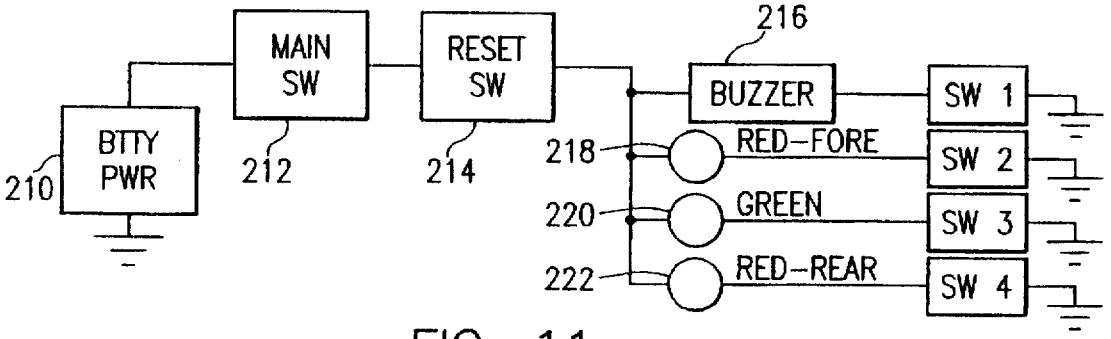
FIG. 11 provides an electrical schematic for one embodiment of the present invention.

FIG. 11 shows an electrical schematic for the present invention. A battery power 210 is supplied to a main switch 212 and subsequently to a reset or disable switch 214. The output of the reset switch 214 is applied to buzzer 216, red forward light 218, green neutral position light 220 and red rear position light 222. In order to activate either the lights or the buzzer, one of switches SW1–SW4 must be closed. The other side or other terminal of the position switches are connected to ground. The electrical circuit may be modified to supply power from the position sensing unit.

Figure 12:
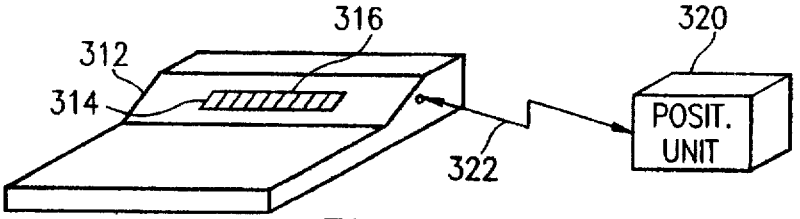
FIG. 12 diagrammatically illustrates an integral visual display as well as a communications link configured as an infrared or as a radio frequency R.F. link between the visual and audio response unit and the position sensing unit; and, FIG. 13 diagrammatically illustrates the tee platform having a flat face and an integral visual display unit.

FIG. 12 diagrammatically illustrates that visual and audio response unit 312 may utilize an integral visual display 314. In this manner, display 314 includes a number of display cells 316 that are progressively and continuously illuminated based upon the position of terminal end 60 of cord 18. In this manner, the golfer can actually see how much forward and rearward swing movement his or her hips are undergoing during the backswing and foreswing of the golf club. Positioning unit 320 sends and receives signals from visual and audio response unit 312 either by an electrical, an infrared telecommunications link or a radio frequency telecommunications link. This I.R. or R.F. type of communications link is identified by double headed arrow 322. If I.R. or R.F. telecommunications are utilized, infrared and R.F. transceivers must be incorporated into visual and audio response unit 312 and position sensing unit 320. This may require that position sensing unit 320 include its own power supply.

Figure 13:
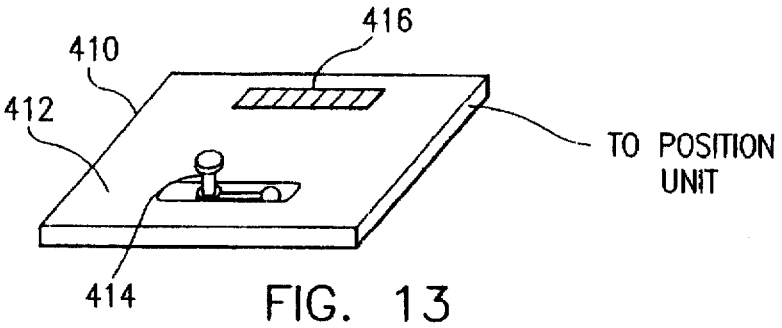

FIG. 13 diagrammatically illustrates a visual and audio response unit 410 and a tee platform 412 which holds a tee 414. The tee platform 412 has a co-extensive or flat surface with respect to visual indicator panel 416. Although an integral visual display panel 416 is shown in conjunction with FIG. 13, the unit can be configured with discrete lamps or light emitting diodes or other light emitting devices to show the position of the hips of the golfer.

The following Dimension Table provides exemplary dimensions for the system components.

Dimension Table

| | |
|---|---|
| Tee platform | 8" × 6" × ¾" |
| Fluorescent sight ball | ½" diameter |
| Elastic cord | 6' |
| Terminus bar height | 1½" |
| Weight | 4 oz. |
| Position switch box height | 7" |
| Spann between switches | 1" |

The claims appended hereto are meant to cover modifications and changes within the spirit and scope of the present invention.

What is claimed is:

1. A golf swing training device for a golfer comprising:

a position sensing unit having a taut, movable cord attached to a hip of the golfer, said position sensing unit including means for generating forward, rearward and fore-strike position signals based upon corresponding forward and rearward optimal positions of the hip and an excessive forward position of the hip for said fore-strike position signal;

a tee mounted on a tee platform; and, a visual and audio response unit on said platform and coupled via a communications link to said position sensing unit, said communications link carrying said forward, rearward and fore-strike position signals between said response unit and said position sensing unit, said visual and audio response unit including a plurality of visual indicators respectively activated by said forward and rearward position signals and including an audio alarm activated by said fore-strike position signal.

2. A golf swing training device as claimed in claim 1 wherein said communications link is an electrical coupling extending between said position sensing unit and said visual and audio response unit.

3. A golf swing training device as claimed in claim 1 wherein said communications link is one of an infrared and a radio frequency telecommunications link.

4. A golf swing training device as claimed in claim 1 wherein said plurality of visual indicators are light emitting indicators which project red light when said hips exceed said forward and rearward optimal positions.

5. A golf swing training device as claimed in claim 1 wherein said visual and audio response unit includes a neutral position visual indicator and said means for generating includes means for generating a neutral position signal which is intermediate said forward and rearward optimal positions of said hip.

6. A golf swing training device as claimed in claim 1 wherein said taut, movable cord is attached to the hip via a clip.

7. A golf swing training device as claimed in claim 1 wherein said position sensing unit includes a plurality of switches activated by a reference position on said cord.

8. A golf swing training device as claimed in claim 7 wherein said position sensing unit includes a movable, biased terminus at a terminal end of said cord and said means for generating including a plurality of switches which change their respective states based upon a position of said terminus.

9. A golf swing training device as claimed in claim 8 wherein said terminus is biased by one of a gravitational force and a spring force.

10. A golf swing training device as claimed in claim 9 wherein each one of said plurality of switches are a mechanical switch and a photo-optic switch.

11. A golf swing training device as claimed in claim 7 wherein said position sensing unit includes a rotationally biased reel for said cord, said reel capturing a terminal end of said cord and said bias gathering said cord on said reel, and means for sensing, as part of said means for generating, a plurality of rotational positions corresponding to said forward and rearward optimal positions and said excessive forward position of the hip.

12. A golf swing training device as claimed in claim 1 wherein said plurality of visual indicators are an integral display unit.

13. A golf swing training device as claimed in claim 1 including a pivotal mount for said tee and a disabling switch coupled to said pivotal mount, said disabling switch turning off said visual and audio response unit when said tee is not upright with respect to said platform.

14. A golf swing training device as claimed in claim 2 wherein said plurality of visual indicators are light emitting indicators which project red light when said hips exceed said forward and rearward optimal positions.

15. A golf swing training device as claimed in claim 14 wherein said visual and audio response unit includes a neutral position visual indicator and said means for generating includes means for generating a neutral position signal which is intermediate said forward and rearward optimal positions of said hip.

16. A golf swing training device as claimed in claim 15 wherein said taut, movable cord is attached to the hip via a clip.

17. A golf swing training device as claimed in claim 16 wherein said position sensing unit includes a plurality of switches activated by a reference position on said cord.

18. A golf swing training device as claimed in claim 17 wherein said position sensing unit includes a movable, biased terminus at a terminal end of said cord and said means for generating including a plurality of switches which change their respective states based upon a position of said terminus.

19. A golf swing training device as claimed in claim 18 wherein said terminus is biased by one of a gravitational force and a spring force.

20. A golf swing training device as claimed in claim 19 wherein each one of said plurality of switches are a mechanical switch and a photo-optic switch.

21. A golf swing training device as claimed in claim 20 including a pivotal mount for said tee and a disabling switch coupled to said pivotal mount, said disabling switch turning off said visual and audio response unit when said tee is not upright with respect to said platform.

22. A method for enhancing a golf swing of a golfer with visual and audible feedback comprising the steps of:

providing a taut, movable cord attached to a hip of said golfer;

sensing the forward and rearward movement of the hip based upon a position of a reference point on said cord with respect to a fixed, neutral position;

generating a first visual signal to the golfer when the hip moves beyond a forward optimal position based upon movement of the reference point with respect to said fixed, neutral position;

generating a second visual signal to the golfer when the hip moves beyond a rearward optimal position based upon movement of the reference point with respect to said fixed, neutral position;

generating an audible signal to said golfer when the hip moves beyond an excessive forward position, which is beyond said forward optimal position, based upon movement of the reference point with respect to said fixed, neutral position, said excessive forward position corresponding to an ideal hip position substantially immediately prior to striking a golf ball.

23. A method as claimed in claim 22 wherein the method includes providing a tee for said golf ball and the steps of generating first and second visual signals occurs adjacent said tee.

24. A method as claimed in claim 22 including the step of generating a third visual signal to the golfer when the hip moves between said forward optimal position and said rearward optimal position based upon movement of the reference point with respect to said fixed, neutral position.

25. A golf swing training device for a golfer comprising:

a position sensing unit having a taut, movable cord attached to a hip of the golfer, said position sensing unit including means for generating forward, rearward and fore-strike position signals based upon corresponding forward and rearward optimal positions of the hip and an excessive forward position of the hip for said fore-strike position signal;

a tee mounted on a tee platform;

a visual response unit on said platform and coupled via a communications link to said position sensing unit, said communications link carrying said forward and rearward position signals between said response unit and said position sensing unit, said visual response unit including a plurality of visual indicators respectively activated by said forward and rearward position signals; and, an audio response unit coupled via said communications link to said position sensing unit, said communications link carrying said fore-strike position signals, said audio response unit including an alarm activated by said fore-strike position signal.

* * * * *